United States Patent [19]

Burke et al.

[11] Patent Number: 4,920,895

[45] Date of Patent: May 1, 1990

[54] DRAFTING DEVICE FOR THE CONVENIENT CONTAINMENT OF ERASER SHAVINGS

[76] Inventors: John Burke, 58 Willow St., Wheatley Heights, N.Y. 11798; John Kraljic, 521 Pease La., West Islip, N.Y. 11795

[21] Appl. No.: 334,345

[22] Filed: Apr. 7, 1989

[51] Int. Cl.[5] ..... A47B 17/00

[52] U.S. Cl. ..... 108/26; 108/27; 108/50; 211/88

[58] Field of Search ..... 108/25, 26, 27, 28, 108/50, 90; 211/88

[56] References Cited

U.S. PATENT DOCUMENTS

| | | | |
|---|---|---|---|
| 1,505,803 | 8/1924 | Pylick | 108/90 |
| 2,645,230 | 7/1953 | Knapp | 108/26 X |
| 2,861,386 | 11/1958 | Paulsen et al. | 108/28 X |
| 3,080,141 | 3/1963 | Ricci | 108/26 X |
| 3,389,520 | 6/1968 | Gray et al. | 108/90 X |
| 3,450,071 | 6/1969 | Mack | 108/50 |
| 4,716,840 | 1/1988 | Tringali et al. | 108/27 |
| 4,802,595 | 2/1989 | Northington | 108/26 X |

*Primary Examiner*—Peter A. Aschenbrenner
*Attorney, Agent, or Firm*—Michael I. Kroll

[57] ABSTRACT

A drafting device connectable to a side of a drafting board having a top surface is disclosed. The device has a housing with a top, a pair of sides, a length, and an interior. A storage tray for drafting tools is affixed to the top of the housing. A removable trough is slidably mounted in the interior of the housing and has a retracted position, an extended position, and a pair of lips. A slot is contained on either of the pair of sides of the housing so that eraser shavings can be brushed from the drafting board through the slot and into the trough for keeping the drafting board clean.

16 Claims, 2 Drawing Sheets

FIG. 1
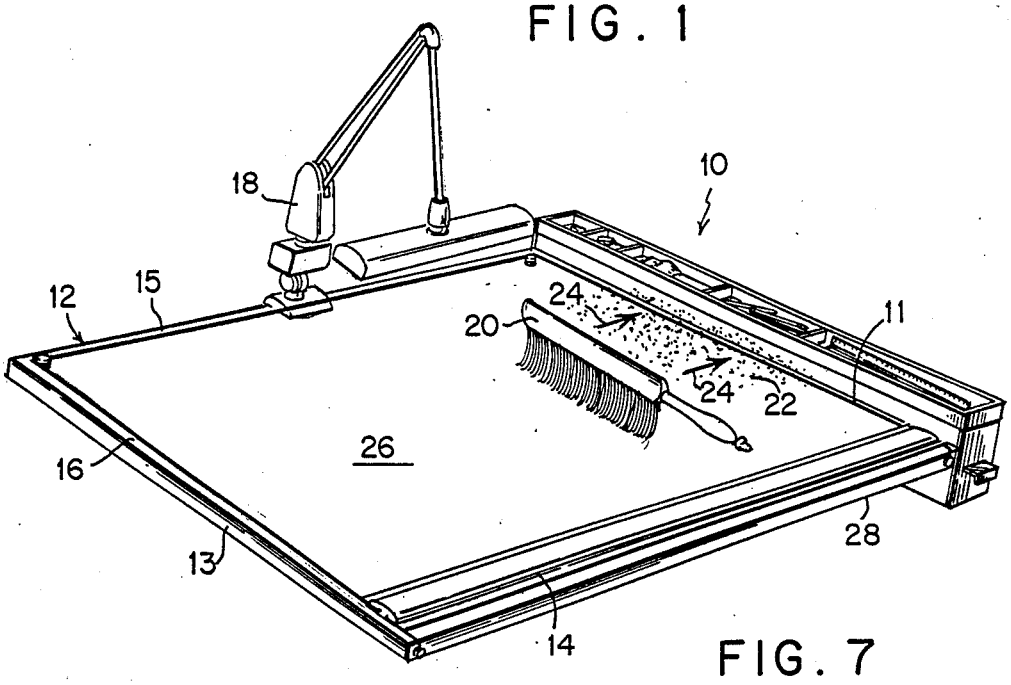
FIG. 2
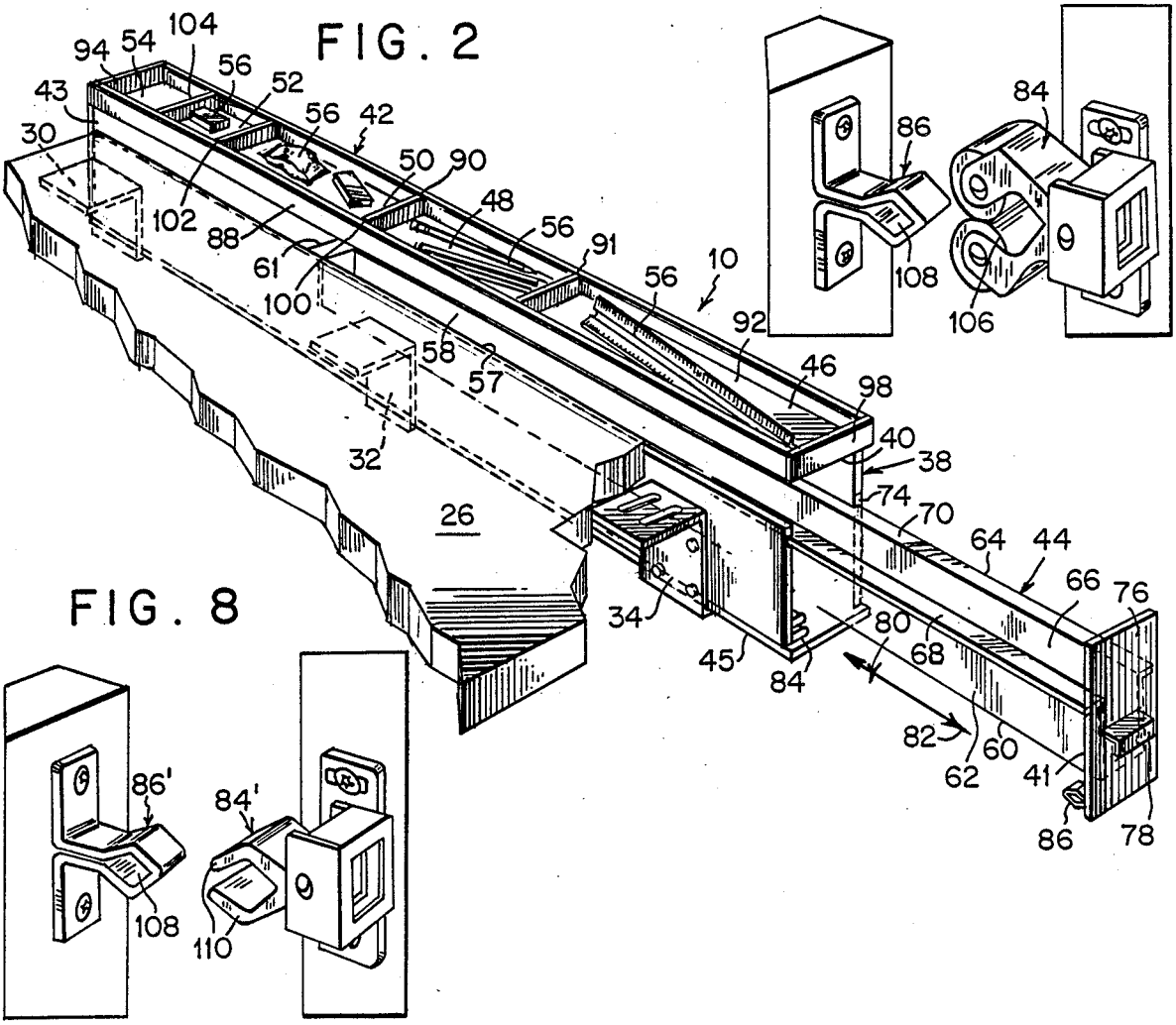
FIG. 7
FIG. 8

DRAFTING DEVICE FOR THE CONVENIENT CONTAINMENT OF ERASER SHAVINGS

BACKGROUND OF THE INVENTION

1. Field of the Invention

The present invention relates to a drafting device.

More particularly, the present invention relates to a drafting device for the convenient containment of eraser shavings.

2. Brief Description of the Prior Art

During the course of drafting, the draftsperson would usually have need to use an eraser. Numerous erasers are available in the art.

When an eraser, either manual or electric type, is used, friction causes shavings to peel off the eraser and deposit on the drawing.

The shavings are numerous and inconvenient to dispose of. Usually the shavings would be brushed off the drafting board and on to the floor to be swept up during the normal cleaning of the area.

The shavings on the floor and also possibly on the draftsperson's clothes can become quite unsightly.

Numerous innovations for drafting devices have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a drafting device which avoids the disadvantages of the prior art.

More particularly, it is an object of the present invention to provide a drafting device that is readily attachable to a side of a drafting board, and it is constructed of durable plastic with steel angles. The steel being used for attachment of the drafting device to the drafting board.

The "Draft - N - Clean" device serves a dual purpose. First, it helps in the cleaning of eraser shavings from the surface of the drafting board. The draftsperson brushes the shavings toward the "Draft -N - Clean" device causing the shavings to fall into a removable trough. The trough requires periodic cleaning whose frequency depends upon the amount of use.

Secondly, the upper portion of the "Draft - N -Clean" device provides a sectional tray for storing drafting tools and supplies, such as scales, pencils, etc.

In keeping with these objects, and with others which will become apparent hereinafter, one feature of the present invention resides, briefly stated, in a drafting device connectable to a side of a drafting board having a top surface, a housing having a top, a pair of sides, a length, and an interior; a storage tray for drafting tools which is affixed to the top of the housing; a removable trough slidably mounted in the interior of the housing and having a retracted position, an extended position, and a pair of lips; wherein cleaning means are contained on either of the pair of sides of the housing.

When the Draft - N - Clean is designed in accordance with the present invention, eraser shavings can be brushed from the drafting board through the cleaning means and into the trough for easy disposal while keeping the drafting board clean.

In accordance with another feature of the present invention, the cleaning means include a slot with a bottom edge substantially extending the length of the housing.

Another feature of the present invention is that it further comprises fastening means.

Yet another feature of the present invention is that the fastening means include a plurality of angle brackets so that the drafting device can be connected to either side of the drafting board in such a position where the bottom edge of the slot substantially meets the top surface of the drafting board and the pair of lips of the trough so that a smooth communication between the top surface of the drafting board and the pair of lips of the trough is provided.

Still another feature of the present invention is that the plurality of angle brackets are three angle brackets.

Yet still another feature of the present invention is that the storage tray contains a plurality of compartments defined by a plurality of partitions.

Still yet another feature of the present invention is that the plurality of compartments is five compartments.

Another feature of the present invention is that the plurality of partitions is four partitions.

Yet another feature of the present invention is that the trough has a free end, a closed end and a substantially "U" - shape configuration with two vertical members each having a free end and one horizontal member.

Still another feature of the present invention is that each of the pair of lips is disposed on each of the free ends of the vertical members.

Yet still another feature of the present invention is that each of the pair of sides of the housing contain an internal recess extending substantially the length of the housing for slidably receiving the pair of lips of the trough so that when the trough requires emptying the trough is pulled out to the extended position and removed from the housing for emptying the shavings.

Still yet another feature of the present invention is that the trough has a front plate with a back side affixed to the free end of the trough.

Another feature of the present invention is that the front plate has a handle so that the trough can achieve the retracted position and the extended position more easily.

Yet another feature of the present invention is that is further comprises means to keep the trough in the retracted position inside the housing.

Still another feature of the present invention is that the closing means has a hidden catch with a first part and a second part.

Yet still another feature of the present invention is that the first part of the catch is disposed inside the housing and the second part of the catch is disposed on the back side of the front plate of the trough.

Still yet another feature of the present invention is that the housing, the storage tray, and the trough are made from durable plastic.

Another feature of the present invention is that the plurality of angle brackets are made from steel.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 1 is a perspective view of the "Draft - N -Clean" device of the present invention being used;

FIG. 2 is perspective view of the present invention shown in FIG. 1 with parts removed;

FIG. 7 is a perspective view of the catch of the present invention shown in FIGS. 1 and 2; and FIG. 8 is a perspective view of an alternate embodiment of the catch of the present invention shown in FIGS. 1 and 2.

LIST OF REFERENCE NUMERALS UTILIZED IN THE DRAWING

Figure 3:
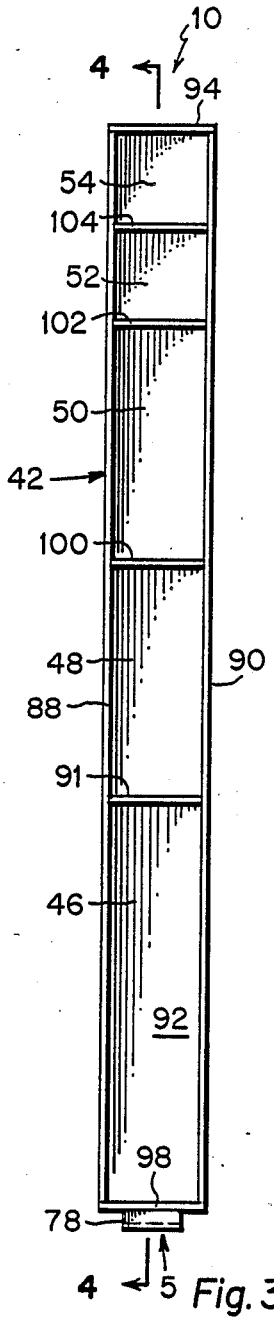
FIG. 3 is a plan view of the "Draft - N - Clean" device of the present invention shown in FIGS. 1 and 2.

10 -Draft - N - Clean device
11 - side of the conventional drafting board 12
12 - conventional drafting board
13 - side of the conventional drafting board 12
14 - conventional drafting board straight edge
15 - top of the conventional drafting board 12
16 - conventional track wire for use with the conventional drafting board straight edge.
18 - conventional drafting light
20 - brush
22 - eraser shavings
24 - arrows
26 - upper surface of the conventional drafting board 12
28 - lower surface of the conventional drafting board 12
30 - rear angle
32 - intermediate angle
34 - front angle
38 - hollow housing
40 - top of the hollow housing 38
41 - free end of the trough 44
42 - storage tray
43 - back of the hollow housing 38
44 - trough
45 - bottom of the hollow housing 38
46 - first compartment of the storage tray 42
48 - second compartment of the storage tray 42
50 - third compartment of the storage tray 42
52 - fourth compartment of the storage tray 42
54 - fifth compartment of the storage tray 42
56 - drafting tools
57 - bottom of the slot 58
58 - slot
60 - closed bottom of the trough 44
61 - closed back of the trough 44
62 - first side of the trough 44
64 - second side of the trough 44
66 - open top of the trough 44
68 - lip on the trough 44
70 - lip on the trough 44
72 - recess in the first side 62
74 - recess in the second side 62
76 - trough front 44
78 - pull handle on the trough front 44
80 - arrow indicating direction of the trough 44 during retraction
82 - arrow indicating direction of the trough 44 during extension
84 - catch part
86 - catch part
88 - first side of the storage tray 42
90 - second side of the storage tray 42
91 - first partition defining the first compartment 46 of the storage tray 42
92 - bottom side of the storage tray 42
94 - back side of the storage tray 42
98 - front side of the storage tray 42
100 - second partition defining the second compartment 48 of the storage tray 42
102 - third partition defining the third compartment 50 of the storage tray 42
104 - fourth partition defining the fourth compartment 52 of the storage tray 42
106 - pair of rollers of the catch part 84
108 - extension of the catch part 86'
110 - pair of resilient legs of the catch part 84'
84' - alternate embodiment of the catch part 84
86' - alternate embodiment of the catch part 86

DETAILED DESCRIPTION OF THE PREFERRED EMBODIMENT

Referring now to FIG. 1, the draft - N - clean device of the present invention is shown generally at 10. The "Draft - N - Clean" device 10 is connectable to a side 11 or a side 13 of a conventional drafting board 12, depending upon if the user is right handed or left handed. The conventional drafting board 12 has a top 15, an upper surface 26, and a lower surface 28.

The Draft - N - Clean device 10 is made from durable plastic, but is not limited to it. Located on the conventional drafting board 12 is a conventional drafting straight edge 14 guided by a conventional track wire 16.

A conventional drafting light 18 is attachable to the top 15 of the conventional drafting board 12.

A brush 20 is provided to remove accumulated eraser shavings 22 by brushing the shavings 22 in the direction of arrows 24 towards the Draft - N -Clean device 10.

As shown in FIG. 2 the Draft - N - Clean device 10 is connectable to the conventional drafting board 12 by a rear angle 30, an intermediate angle 32, and a front angle 34. The angles 30, 32, and 34 may be made from steel, but are not limited to it.

The Draft - N - Clean device 10 includes a hollow housing 38 having a back 43, a bottom 45, and a top 40 which is mounted to a storage tray 42. Internal to the housing 38 is a trough 44.

The storage tray 42 contains a first compartment 46, a second compartment 48, a third compartment 50, a fourth compartment 52, and a fifth compartment 54. The compartments 46 through 54 are used for convenient placement of drafting tools 56.

A slot 58 extends substantially the length of the housing 38 and is located between the upper surface 26 of the conventional drafting board 12 and the storage tray 42. The slot 58 can be on either side of the housing 38 depending upon whether the user is right or left handed.

The trough 44 is substantially a "U" - shaped member, with a free end 41, a closed bottom 60, a closed back 61, a first side 62, a second side 64, and an open top 66.

Furthermore, the trough 44 contains lip 68 and lip 70 which slide on a recess 72 and a recess 74 in the first side 62 and the second side 64, respectfully, of the housing 38.

The trough front 76 is affixed to the free end 41 of the trough 44. The trough front 76 contains a pull handle 78. The pull handle 78 assists in the extending and retracting of the trough 44 in the directions of arrows 80 and 82.

The lips 68 and 70 of the trough 44 ride in the recesses 72 and 74 of the housing 38 as the trough 44 extends and retracts. When the trough 44 retracts completely, catch part 84 mates with catch part 86 and keeps the trough 44 closed.

Figure 4:
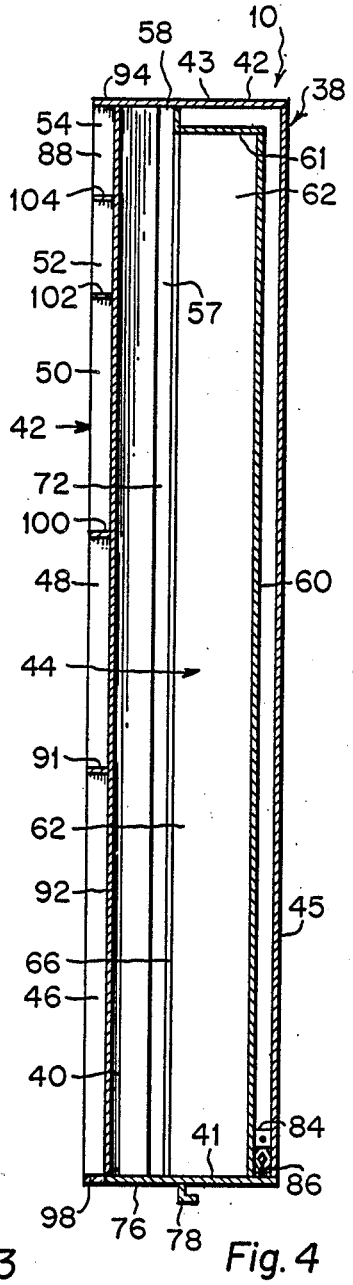
FIG. 4 is a cross-sectional view shown in FIGS. 1 and 2 taken along line 4—4 in FIG. 3.
Figure 6:
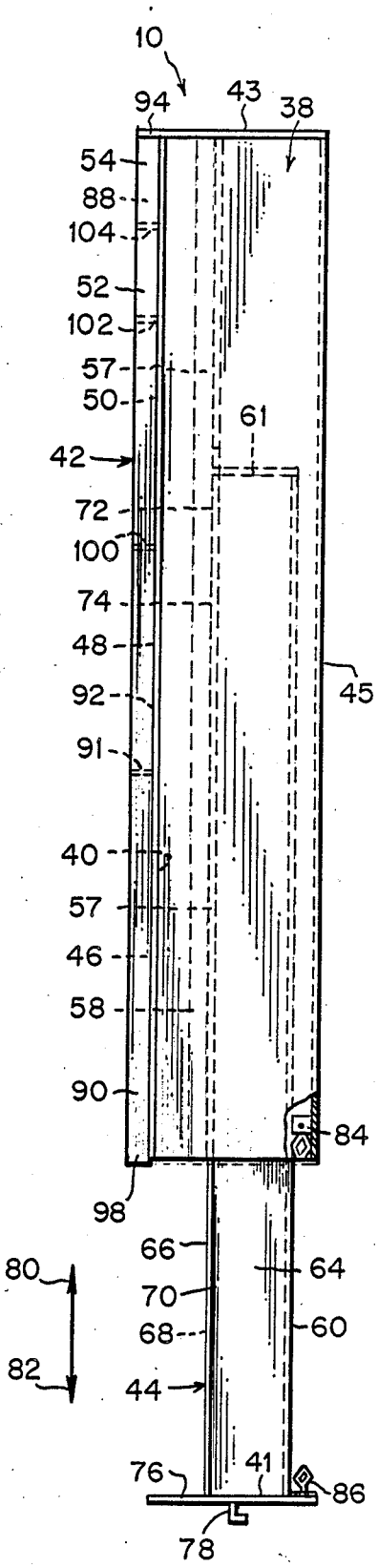
FIG. 6 is a side view of the present invention shown in FIGS. 1 and 2, with the trough in the extended position.
Figure 5:
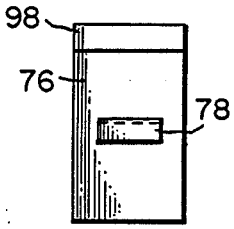
FIG. 5 is a front view of the present invention shown in FIGS. 1 and 2 taken in the direction of arrow 5 in FIG. 3.

Referring now to FIGS. 2 through 6, which depicts the storage tray 42. The storage tray 42 has a first side 88, a second side 90, a bottom 92, a back 94, and a front 98.

To define the first compartment 46, a first partition 91 is provided. To define the second compartment 48, a second partition 100 is provided. To define the third compartment 50, a third partition 102 is provided. To define the fourth compartment 52, a fourth partition 104 is provided.

In operation, the Draft - N - Clean device 10 is attached to the side 11 or the side 13 of the drafting board 12 depending upon whether the user is right handed or left handed. The Draft - N - Clean device 10 is attached to the drafting board 12 by the use of the rear angle 30, the intermediate angle 32, and the front angle 34. The bottom of the slot 58 lines up with the top surface 26 of the conventional drawing board 12.

When the user begins, the trough 44 is extended from the housing 38 and checked for any eraser shavings 22 that have previously been brushed by the brush 20, through the slot 58, and into the trough 44.

If the shavings 22 are present, the trough 44 is slid out and removed from the Draft - N - Clean device 10 and has its contents discarded.

The trough 44 is then returned to the housing 38 so that the lips 68 and 70 of the trough 44 mate with the recesses 72 and 74 in the housing 38. The trough 44 is slid closed and is ready for use.

The trough 44 remains closed due to the action of the catch part 84 mating with the catch part 86.

There are three kinds of catches commonly used; magnetic, roller, and spring or friction.

A magnetic catch has some definite advantages over the other two types. One is that if the door warps, the magnetic catch will still be strong enough to close it; no matter where the other part of the catch is, the magnet is almost bound to grip it, because most magnets are of the floating kind and are self-adjusting. In other words, only part of the magnet needs to contact the catch on the door.

The roller catch consists of two rollers set closed together; a part on the door interlocks with them.

One other type of catch is the spring (friction) type, good for when all hardware is not to show. This catch is simple to operate: The latch is pushed closed and pushed again to open.

As shown in FIG. 7, the catch part 84 contains a pair of rollers 106 and the catch part 86 contains an extension 108 which in the closed position, enters between the pair of rollers 106 and is held fast due to the action of a spring.

Another type of excepted catch is shown in FIG. 8. The catch part 84' contains a pair of resilient legs 110 while the catch part 86' contains an extension 108 which in the closed position, enters between the pair of resilient legs 110 and is held fast due to the resilient action of the pair of resilient legs 10.

It will be understood that each of the elements described above, or two or more together, may also find a useful application in other types of constructions differing from the type described above.

While the invention has been illustrated and described as embodied in a Draft - N - Clean device, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt is for various applications without omitting features that, from the standpoint of prior art, fairly constitute essential characteristics of the generic or specific aspects of this invention.

We claim:

1. A drafting device connectable to a side of a drafting board having a top surface, comprising:

(a) a housing containing a trough having a top, a pair of sides, a length, an interior, and including a slot contained on either of said pair of sides of said housing so that eraser shavings can be brushed from the drafting board through said slot contained on said housing and into said trough for keeping said drafting board free of eraser shavings;

(b) a storage tray for drafting tools and being affixed to said top of said housing; and (c) said removable trough being slidably mounted in said interior of said housing and having a retracted position, an extended position, and a pair of lips, said pair of lips affixed to said trough and slideable in said housing so that said trough can slide from said retracted position to said extended position and back and fourth, each of said pair of sides of said housing contain an internal recess extending substantially said length of said housing for slidably receiving said pair of lips of said trough so that when said trough requires emptying said trough is pulled out to said extended position and removed from said housing for emptying the shavings and henceforth returned thereto.

2. A device as defined in claim 1, wherein said slot contained on said housing has a bottom edge substantially extending said length of said housing.

3. A device as defined in claim 1; further comprising fastening means, said fastening means including a plurality of angle brackets so that the drafting device can be connected to either side of the drafting board in such a position where said bottom edge of said slot of said housing substantially meets the top surface of the drafting board and said pair of lips of said trough so that a smooth communication between the top surface of the drafting board and said pair of lips of said trough is provided.

4. A device as defined in claim 3, wherein said plurality of angle brackets are three angle brackets.

5. A device as defined in claim 1, wherein said storage tray contains a plurality of compartments defined by a plurality of partitions.

6. A device as defined in claim 5, wherein said plurality of compartments is five compartments.

7. A device as defined in claim 5, wherein said plurality of partitions is four partitions.

8. A device as defined in claim 1, wherein said trough has a free end, a closed end, and a substantially "U" - shape configuration with two vertical members each having a free end and one horizontal member.

9. A device as defined in claim 8, wherein each of said pair of lips is disposed on each of said free ends of said vertical members.

10. A device as defined in claim 8, wherein said trough has a front plate with a back side affixed to said free end of said trough.

11. A device as defined in claim 10, wherein said front plate has a handle so that said trough can achieve said retracted position and said extended position more easily.

12. A device as defined in claim 1, further comprising means to keep said trough in said retracted position inside said housing.

13. A device as defined in claim 12, wherein said closing means include a hidden catch with a first part and a second part.

14. A device as defined in claim 13, wherein said first part of said catch is disposed inside said housing and said second part of said catch is disposed on said back side of said front plate of said trough.

15. A device as defined in claim 1, wherein said housing, said storage tray, and said trough are made from durable plastic.

16. A device as defined in claim 3, wherein said plurality of angle brackets are made from steel.

* * * * *